US010475617B2

(12) United States Patent
Durand et al.

(10) Patent No.: US 10,475,617 B2
(45) Date of Patent: Nov. 12, 2019

(54) INTERNAL LOAD FOR A TRAVELLING WAVE TUBE USING A FOLDED-WAVEGUIDE SLOW-WAVE STRUCTURE

(71) Applicant: THALES, Courbevoie (FR)

(72) Inventors: Alain Durand, Velizy-Villacoublay (FR); Thomas Hardy, Paris (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/191,383

(22) Filed: Nov. 14, 2018

(65) Prior Publication Data

US 2019/0164714 A1 May 30, 2019

(30) Foreign Application Priority Data

Nov. 28, 2017 (FR) ..... 17 01253

(51) Int. Cl.

| | |
|---|---|
| ***H01J 23/24*** | (2006.01) |
| ***H01J 23/26*** | (2006.01) |
| ***H01J 25/36*** | (2006.01) |
| ***H01P 9/00*** | (2006.01) |
| ***H01J 25/02*** | (2006.01) |
| ***H01J 25/38*** | (2006.01) |

(52) U.S. Cl.

CPC ..... *H01J 23/24* (2013.01); *H01J 23/26* (2013.01); *H01J 25/025* (2013.01); *H01J 25/36* (2013.01); *H01J 25/38* (2013.01); *H01P 9/006* (2013.01)

(58) Field of Classification Search

None

See application file for complete search history.

(56) References Cited

U.S. PATENT DOCUMENTS

| | | | | |
|---|---|---|---|---|
| 4,695,766 | A * | 9/1987 | Waterman | H01J 25/38 315/3.5 |
| 5,422,596 | A | 6/1995 | Armstrong et al. | |
| 2012/0081003 | A1 | 4/2012 | Baik et al. | |
| 2018/0337016 | A1* | 11/2018 | Masuda | H01J 23/28 |
| 2019/0035592 | A1* | 1/2019 | Durand | H01J 23/165 |

OTHER PUBLICATIONS

Kory, et al., "Microfabricated W-band traveling wave tubes", Infrared and Millimeter Waves and 13th International Conference on Terahertz Electronics, vol. 1, pp. 85-86, Sep. 19, 2005.

Liao, et al., "A Rectangular Groove-Loaded Folded Waveguide for Millimeter-Wave Traveling-Wave Tubes", IEEE Transactions on Plasma Science, vol. 38, Issue: 7, Jul. 1, 2010.

* cited by examiner

*Primary Examiner* — Jany Richardson

(74) *Attorney, Agent, or Firm* — Baker & Hostetler LLP

(57) ABSTRACT

A folded-waveguide slow-wave structure equipped with an internal load, includes a central plate comprising a rectilinear beam tunnel of same direction as the longitudinal axis of the central plate, and a serpentine-shaped folded slit having its folds in the direction of the width of the waveguide; a lower plate and an upper plate closing the waveguide, the plates being placed on and under the central plate, respectively; at least one groove of cross section that may be variable, produced along the longitudinal axis of the waveguide, in at least one face internal to the waveguide of the lower plate, the upper plate or the central plate, and at least partially comprising a lossy material; in order to form a closed slow-wave structure through which propagates a hybrid slow wave the amplitude of which is attenuated by at least 20 dB between the start and the end of the portion of the one or more grooves containing a lossy material.

8 Claims, 5 Drawing Sheets

INTERNAL LOAD FOR A TRAVELLING WAVE TUBE USING A FOLDED-WAVEGUIDE SLOW-WAVE STRUCTURE

CROSS-REFERENCE TO RELATED APPLICATIONS

This application claims priority to foreign French patent application No. FR 1701253, filed on Nov. 28, 2017, the disclosure of which is incorporated by reference in its entirety.

FIELD OF THE INVENTION

The present invention relates to a folded slow-wave structure or delay line for a travelling wave tube (TWT).

BACKGROUND

In most microwave tubes the interaction between the wave and the beam is divided into two steps:

- a first step in which electrons are grouped into bunches, i.e. in which the density of the current of the beam is modulated depending on the frequency of the microwave signal; and
- a second step in which the bunches of electrons thus obtained are placed in a phase in which they are slowed by the field in order to transfer their energy to the wave.

In the case of TWTs, the electrons are grouped into bunches by placing the beam in the field of a travelling wave the phase velocity of which is equal to the velocity of the electrons. In a moving coordinate system, the electrons see the field of a stationary wave. The electrons are slowed down in one half-wave and accelerated in the following one. A bunch of electrons forms around the phase for which an accelerating field changes to a decelerating field.

A conventional waveguide, of rectangular or cylindrical cross section, is not suitable for this type of interaction because the phase velocity of the wave that propagates through this waveguide is higher than the velocity of light whereas the velocity of the electrons is lower than the velocity of light. In addition, an electric field parallel to the movement of the electrons is required whereas the fundamental mode of rectilinear waveguides of rectangular or cylindrical cross section is perpendicular to the axis of the waveguide. To obtain a phase velocity lower than that of light a special waveguide called a slow-wave structure or delay line is required. Most often, the delay line is a periodic line obtained by repetitively translating a basic cell, in order to obtain a succession of identical cells. This is the case for helix TWTs, coupled-cavity TWTs, interdigital-line TWTs, etc.

In the field of TWTs operating at millimeter wavelengths a folded-waveguide delay line is often used. This type of line is obtained by periodically positioning sections of rectangular waveguide perpendicular to the axis of the beam, and by alternatively connecting the sections of straight waveguide with bends generating 180° E-plane rotations. Seen from the side, the folded waveguide is serpentine-shaped. The beam tunnel is located in the middle of the straight sections of rectangular waveguide. The electric field in the waveguides is perpendicular to the broadside of the waveguide, and therefore parallel to the movement of the electrons, thereby allowing the beam to be modulated. The electrons therefore move through the beam tunnel, enter into a straight waveguide section, where they experience the action of the electric field (interaction space), pass back through the beam tunnel and enter into the following interaction space. The electrons therefore see the successive interaction spaces with a period equal to the pitch of the line, whereas the geometric period of the line is equal to two times the pitch. The pitch corresponds to the distance between two straight waveguides separated by a bend.

The length of the folded waveguide (straight portion and bends) is determined so that the phase shift of the wave in the waveguide corresponds to the phase variation related to the movement of electrons from one interaction space to the next.

Travelling-wave tubes use a delay line including a number of sections higher than or equal to 2. The input section is terminated by a load and the output section starts with a load. Intermediate sections start and end with a load. The term "load" is understood to mean a volume containing a material that absorbs RF waves, connected to the delay line such that, in the connection plane, the impedance presented by the volume is as close as possible to the characteristic impedance of the delay line so as to ensure a good match (i.e. to minimize the wave reflected by the load).

FIG. 1 schematically shows a slow-wave structure or delay line for a travelling wave tube comprising three sections 1, 2 and 3. The delay line shown comprises an input 4 and an output 5.

The loads 6 at the output of the first section 1, at the input of the second section 2, at the output of the second section 2, and at the input of the third section 3 are called sever loads. Between the end of one line and the start of the following one the electron beam passes through a beam tunnel in which the RF wave does not propagate, and as a consequence has no bunching action, this contributing to debunching of the beam (this is therefore a loss of modulation).

If the reflection coefficients at the two ends of a section and the gain of the section are too high, an oscillation may be observed in this delay-line section. For this reason, the length of the various sections is determined so as to limit gain, on account of the reflection coefficient of the sever loads.

The most commonplace TWTs, an example of which is illustrated in FIG. 2, use a delay line comprising a helix 7 that is held in an envelope 8 by three dielectric rods 9.

In a delay line of the type in FIG. 2, loads are generally produced by depositing, on the rods 9 supporting the helix 7, a layer of lossy material, such as graphite. A lossy material is characterized by a finite electrical conductivity G (in contrast to a perfect conductor the electrical conductivity of which is infinite), resulting in a conduction current $\sigma E$ (E being the electric field) and resistive losses $\sigma E^2$. In a lossy medium the wave undergoes an exponential attenuation as a function of distance. By varying the thickness of the deposit, a load is produced the attenuation (microwave loss) and reflection coefficient of which increase gradually, thus allowing a good match to be obtained over a wide frequency band.

In such a helix delay line, the length of the load leads to a substantial loss of modulation, and therefore to a decrease in the gain of the TWT, which it is necessary to compensate for by increasing the gain of the other sections and therefore the total length of the TWT.

FIG. 3 schematically shows the attenuation on a rod 9 as a function of the thickness z of the deposit of the lossy material, such as graphite. The higher the attenuation, the darker the grey colour that represents it.

In the case of a TWT using a folded-waveguide delay line, it is known to interrupt the modulations in order to pass from a folded waveguide 10 to a straight waveguide 11 in which a load that absorbs electromagnetic energy is placed. Such a straight waveguide may either be parallel, as shown in FIGS. 4 and 5, or perpendicular, as shown in FIG. 6, to the beam tunnel 12.

In such embodiments, although the same waveguide cross section is used, the periodic folded-waveguide line and the straight waveguide containing the load do not have the same impedance and it is necessary to insert a matching circuit at the transition from one line to the other, which is not wide band, and limits the bandwidth of the TWT.

As a variant, as shown in FIG. 7, it is known to interrupt the folded-waveguide delay line in order to allow insertion of a lossy dielectric block 13 of a geometry determined to minimize the reflections of the load.

This variant comprises an abrupt transition between the periodic folded waveguide 10 and the lossy dielectric block 13, which is equivalent to loading the periodic folded waveguide 10 with a lossy resonator possessing many resonances, this limiting the frequency band in which the load is well matched.

SUMMARY OF THE INVENTION

One aim of the invention is to mitigate the aforementioned problems.

According to one aspect of the invention, a folded-waveguide slow-wave structure equipped with an internal load is provided, this structure comprising:

- a central plate comprising a rectilinear beam tunnel of same direction as the longitudinal axis of the central plate, and a serpentine-shaped folded slit having its folds in the direction of the width of the waveguide;
- a lower plate and an upper plate closing the waveguide, said plates being placed on and under the central plate, respectively;
- at least one groove of cross section that may be variable, produced along the longitudinal axis of the waveguide, in at least one face internal to the waveguide of the lower plate, the upper plate or the central plate, and at least partially comprising a lossy material;
- in order to form a closed slow-wave structure through which propagates a hybrid slow wave the amplitude of which is attenuated by at least 20 dB between the start and the end of the portion of the one or more grooves containing a lossy material.

Thus, the reflections of the load are minimized, and the attenuation of the electromagnetic energy is not abrupt.

The losses are gradually introduced into the folded-waveguide line, this having an analogy to the gradual increase in the thickness of the graphite deposit on helix supports.

In one embodiment, the material is a lossy dielectric (usually characterized by the loss tangent).

Thus, the wave undergoes an exponential attenuation with a maximum of power dissipated at the start of the attenuated zone if the distribution of the lossy material is uniform.

According to one embodiment, at least one groove has a constant cross section and comprises an amount of a given lossy dielectric that increases as the abscissa increases along the axis of the waveguide oriented in the direction of wave propagation.

Thus, a small proportion of the power may be absorbed at the start of the load and a higher proportion subsequently, the advantage of this being to better distribute the dissipated power over the length of the load.

In one embodiment, at least one groove has a cross section that remains constant or that increases as said abscissa increases and is filled with lossy dielectric the level of microwave losses of which increases as said abscissa increases.

Thus, a small proportion of the power may be absorbed at the start of the load and a higher proportion subsequently, this having the advantage of better distributing the dissipated power over the length of the load.

As a variant, the lossy material is a layer of a mixture of metals chosen from iron, nickel, molybdenum and titanium, at least partially covering the internal surface of a groove.

Thus, it is not necessary to machine a dielectric block, then to braze this block or to crimp fasten it to the lower and upper plates in order to ensure heat flow between the dielectric block in which the power is dissipated and the cold source placed around the delay line.

For example, at least one groove has a cross section the edge length of which remains constant and comprises an amount of a layer of said same mixture of metals that increases as said abscissa increases.

As a variant, at least one groove has a cross section the edge length of which remains constant or increases as said abscissa increases and comprises a layer of said same mixture of metals.

According to another aspect of the invention, a process for manufacturing a folded-waveguide slow-wave structure equipped with an internal load is also provided, this process comprising steps consisting in:

- drilling in a central plate a rectilinear beam tunnel of same direction as the longitudinal axis of a central plate, and a serpentine-shaped folded slit having its folds in the direction of the width of the waveguide;
- producing at least one groove of cross section that may be variable, along the longitudinal axis of the waveguide, in at least one face internal to the waveguide of a lower plate, of an upper plate or of the central plate, and at least partially comprising a lossy material
- placing the lower plate and the upper plate closing the waveguide, under and on the central plate, respectively;
- so as to form a closed slow-wave structure through which propagates a hybrid slow wave the amplitude of which is attenuated by at least 20 dB between the start and the end of the portion of the one or more grooves containing a lossy material.

In one implementation, the process furthermore comprises a step consisting in closing the waveguide with the lower plate and the upper plate, which are fastened to the lower face and to the upper face of the central plate, respectively.

BRIEF DESCRIPTION OF THE DRAWINGS

The invention will be better understood on studying a few embodiments that are described by way of completely nonlimiting example and that are illustrated by the appended drawings, in which.

In all of the figures, elements referenced with identical references are similar.

DETAILED DESCRIPTION

In the present description, the described embodiments are completely non limiting, and features and functions that are well known to those skilled in the art are not described in detail.

Figure 1:
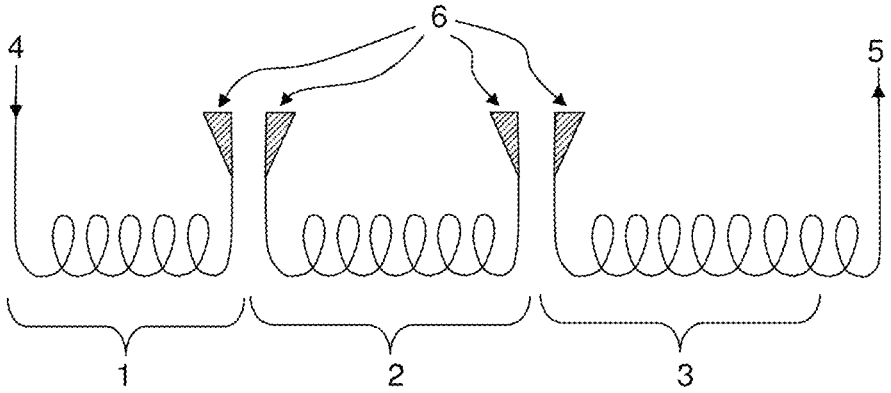
FIG.1 PRIOR ART
FIG. 1 schematically illustrates a slow-wave structure or delay line for a travelling wave tube comprising three sections, according to the prior art.
Figure 2:
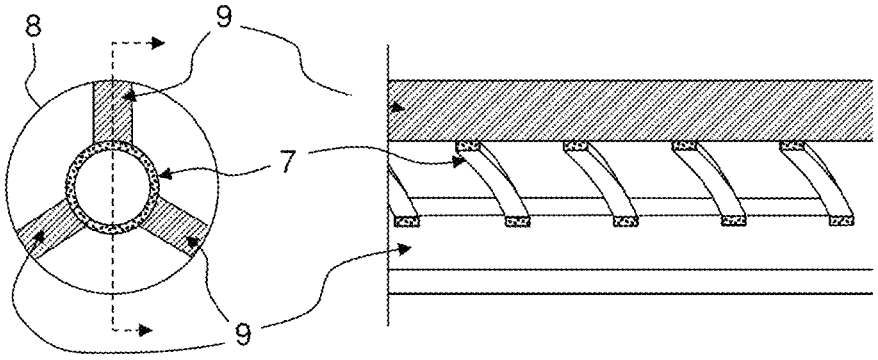
FIG.2 PRIOR ART
FIG. 2 schematically illustrates a delay line comprising a helix held in an envelope by three dielectric rods, according to the prior art.
Figure 3:
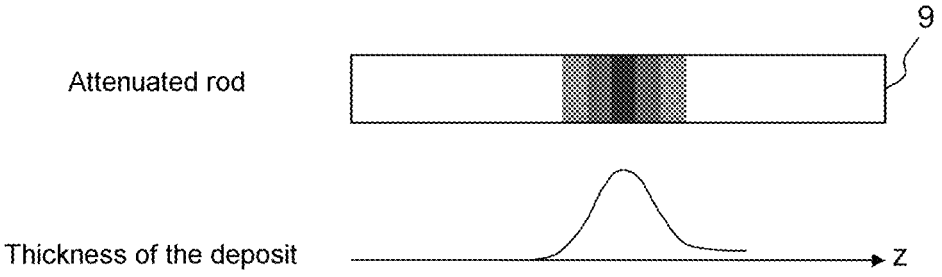
FIG.3 PRIOR ART
FIG. 3 schematically illustrates the attenuation on a rod of a delay line of the type in FIG. 2, as a function of the thickness of the deposit of the material generating the high microwave losses, according to the prior art.
Figure 4:
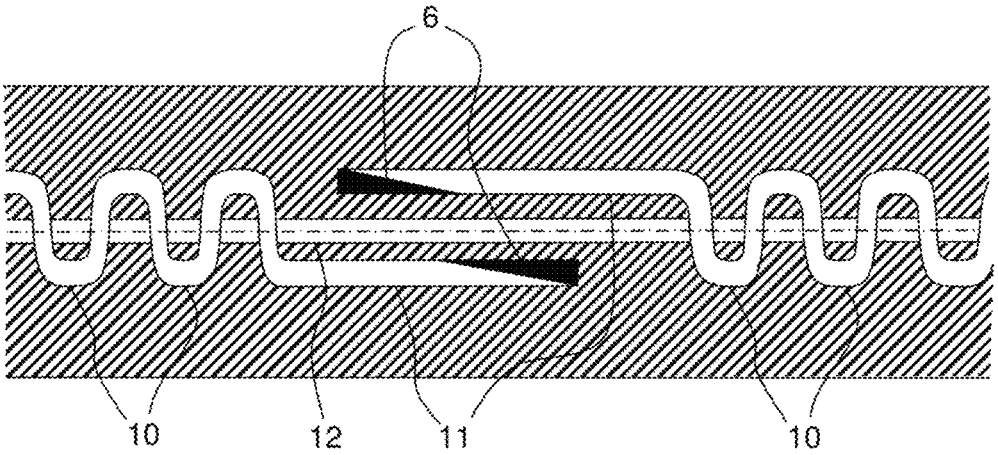
FIG.4 PRIOR ART
FIG. 4 schematically illustrates a folded-waveguide delay line comprising a matched load in a straight waveguide parallel to the beam tunnel, according to the prior art.
Figure 5:
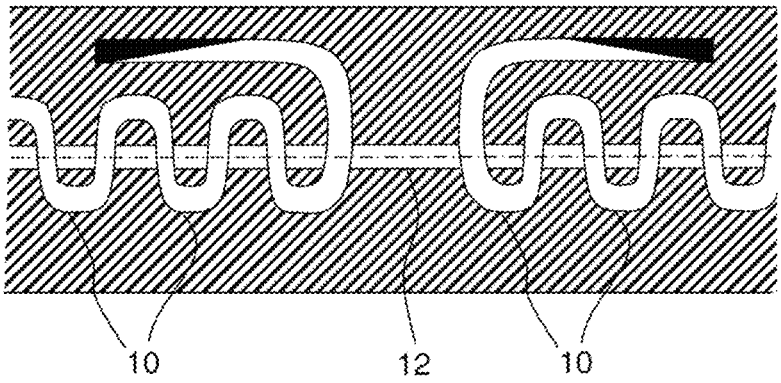
FIG.5 PRIOR ART
FIG. 5 schematically illustrates a folded-waveguide delay line comprising a matched load in a straight waveguide parallel to the beam tunnel and folded toward the cells of the line, according to the prior art.
Figure 6:
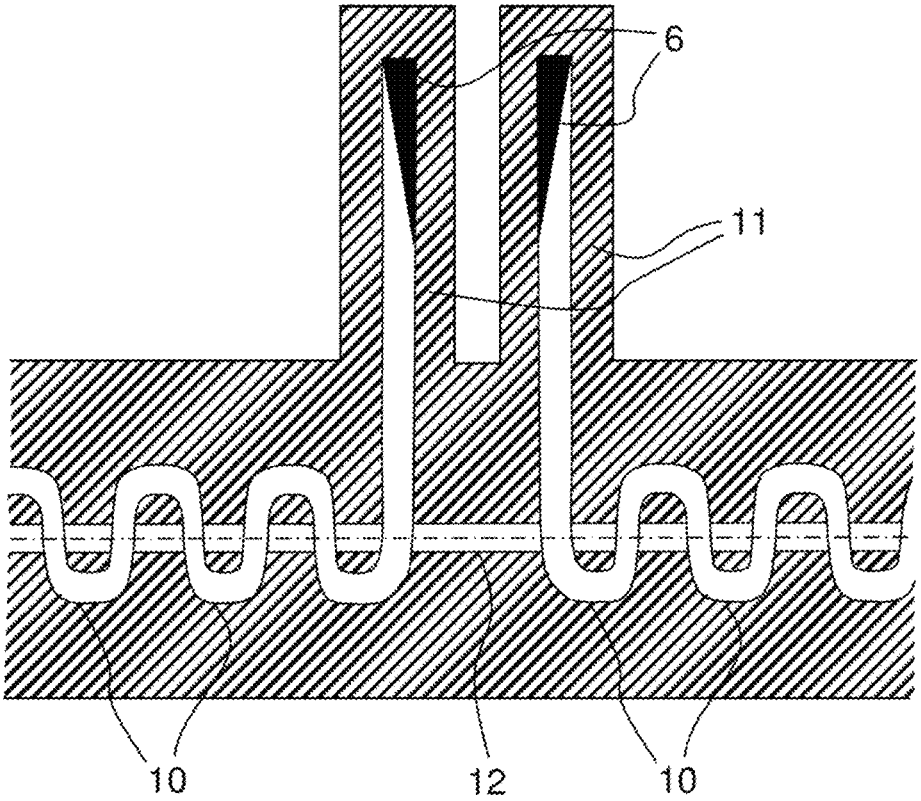
FIG.6 PRIOR ART
FIG. 6 schematically illustrates a folded-waveguide delay line comprising a matched load in a straight waveguide perpendicular to the beam tunnel, according to the prior art.
Figure 7:
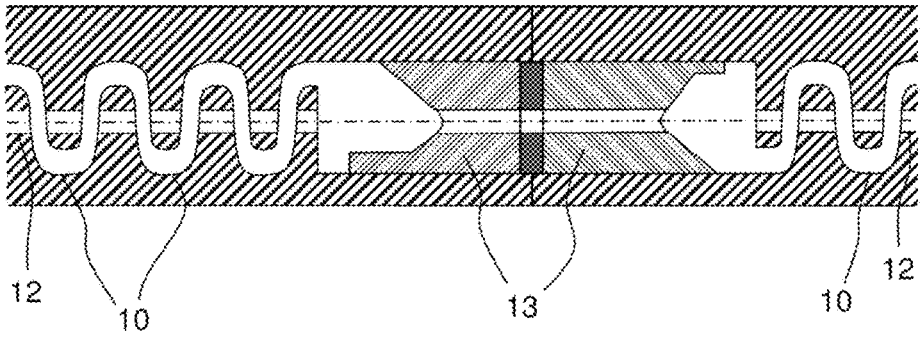
FIG.7 PRIOR ART
FIG. 7 schematically illustrates a folded-waveguide delay line that is interrupted by a lossy dielectric block of a geometry determined to minimize reflections from the load, according to the prior art.
Figure 8:
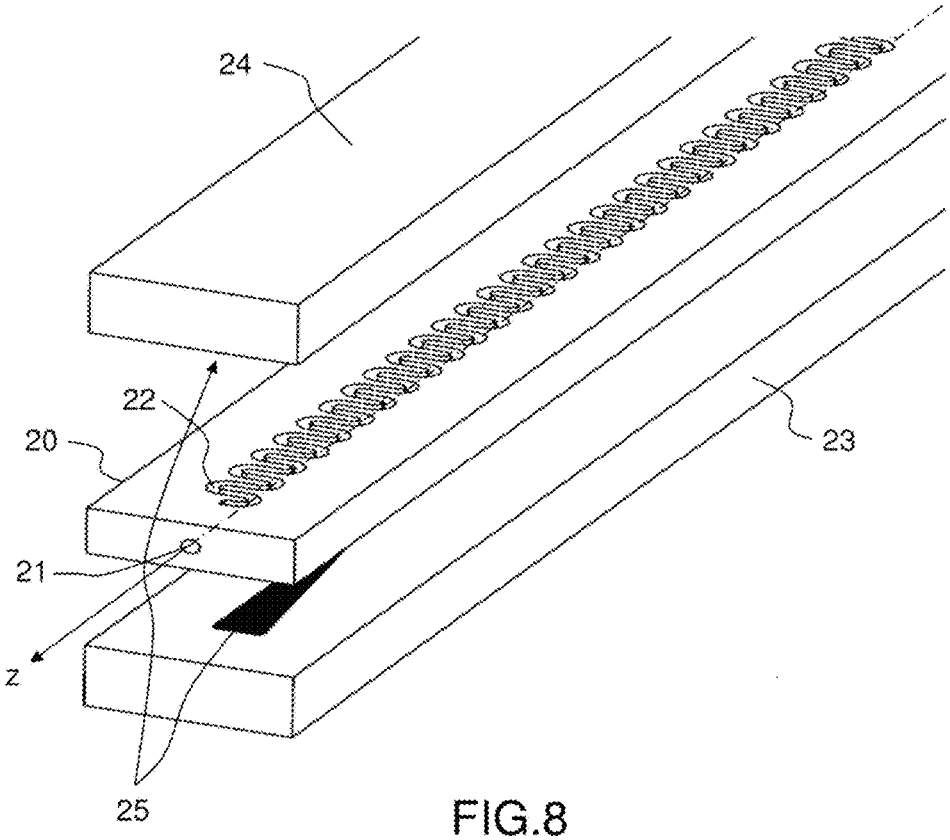
FIGS. 8, 9 and 10 schematically illustrate an overview and cross-sectional views of a folded slow-wave structure for a travelling wave tube, according to one aspect of the invention.

FIG. 8 schematically shows a folded-waveguide slow-wave structure for a travelling wave tube, which is equipped with an internal load comprising:

- a central plate 20 comprising a rectilinear beam tunnel 21 of same direction as the longitudinal axis z of the central plate 20, and a serpentine-shaped folded slit 22 having its folds in the direction of the width of the waveguide;
- a lower plate 23 and an upper plate 24 closing the waveguide, said plates being placed on and under the central plate 20, respectively;
- at least one groove 25 of cross section that may be variable, produced along the longitudinal axis z of the waveguide, in at least one face internal to the waveguide of the lower plate 23, the upper plate 24 or the central plate 20, and at least partially comprising a lossy material;
- in order to form a hybrid slow-wave structure such that the amplitude of a wave is attenuated by at least 20 dB between the start and end of the portion of the one or more grooves containing a lossy material.

In other words, the present invention consists in gradually introducing electromagnetic losses into the folded-waveguide delay line in order to avoid an abrupt transition between the periodic line and a rectangular waveguide, or between the periodic line and a dielectric block, equivalently to the increase in the thickness of the graphite deposit on the rods of a helix delay line known from the prior art.

To do this, the folded-waveguide delay line is coupled to another transmission line that generates high losses, and the coupling between the two lines increases in the direction of propagation of the wave. If a cell is defined as the volume bounded by two planes perpendicular to the axis of the beam and separated by one pitch (i.e. the distance between two straight waveguides separated by one bend), the amplitude of the wave decreases from one cell to the next.

In the example of FIG. 8, two grooves 25 of variable cross section that increases with the abscissa of the z-axis of the waveguide, which grooves are in the present case symmetric with respect to the midplane of the central plate 20, are produced in the face internal to the waveguide of the lower plate 23 and in the face internal to the waveguide of the upper plate 24, and are filled with lossy dielectric, such as a ceramic (alumina, beryllium oxide, aluminum nitride) sintered with elements that generate microwave losses (carbon, iron, titanium, etc.).

The high-electromagnetic-loss transmission line may be machined in the lower plate 23 and/or upper plate 24, which are brazed to the central plate 20 in which the serpentine 22 is machined in order to form the folded-waveguide delay line. It is therefore a question of a waveguide recessed by machining into the lower plate 23 and/or upper plate 24. It may also be partially or completely machined in the central plate 20.

In the example of FIG. 8, the grooves of variable cross section produced in the face internal to the waveguide of the upper plate 24 cannot be seen.

Figure 9:
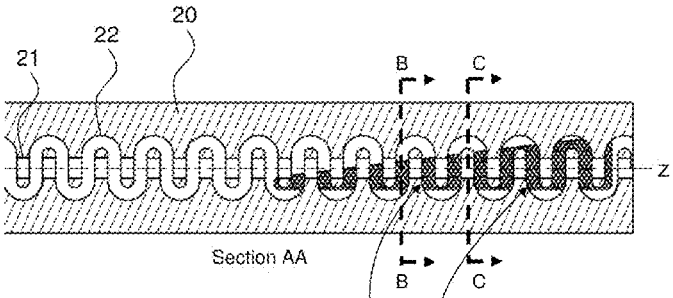

FIG. 9 shows a cross-sectional view of a folded slow-wave structure for a travelling wave tube, according to one aspect of the invention.

Figure 10:
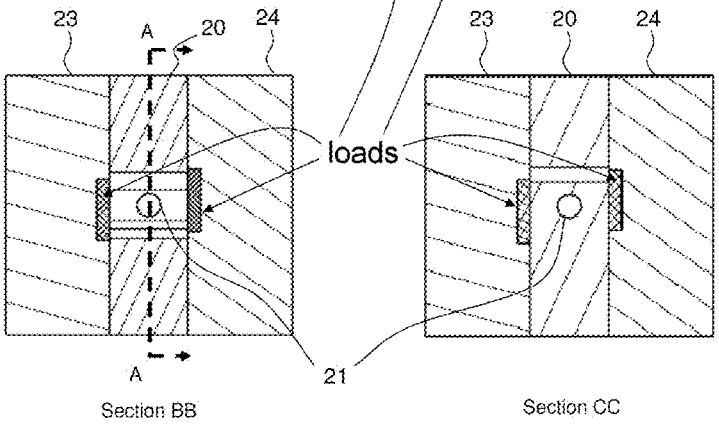

FIG. 10 shows various cross sections of the example in FIG. 9.

As a variant, any embodiment comprising at least one groove 25 of cross section that may be variable (variable or constant), produced along the longitudinal axis z of the waveguide, in at least one face internal to the waveguide of the lower plate, the upper plate or the central plate, and at least partially comprising a lossy material, is possible.

To generate these electromagnetic losses, it is possible to partially or completely fill the grooves 25 with one or various lossy dielectrics, or to deposit one or various lossy materials on the walls, so that along said longitudinal axis oriented in the direction of propagation of the wave, as the abscissa increases, the amplitude of the wave is attenuated by 20 dB between the start and end of the load.

The following are the most explicit cases.

At least one groove 25 may have a constant cross section and comprise an amount of a given lossy dielectric that increases as said abscissa increases.

As a variant, at least one groove 25 may have a cross section that remains constant or increases as said abscissa increases and be full of lossy dielectric the microwave loss level of which increases as the abscissa increases.

As a variant, at least one groove 25 may have a cross section the edge length of which remains constant and comprise an amount of a layer of a given mixture of metals chosen from: iron, nickel, molybdenum and titanium, at least partially covering the internal surface of a groove that increases as the abscissa increases.

As a variant, at least one groove 25 may have a cross section the edge length of which remains constant or increases as said abscissa increases and comprise a layer of a given mixture of metals chosen from: iron, nickel, molybdenum and titanium.

The broadside of the guide machined in the lower and upper plates determines the aperture in the folded-waveguide line, and therefore the coupling between the two transmission lines. A lossy guide of small height may correspond to a guide operating sub cut-off frequency and therefore to a waveguide that prevents energy from propagating into the lossy guide. In this case, the waveguide behaves like a damped resonant cavity coupled to the folded waveguide.

The process for manufacturing such a folded-waveguide slow-wave structure equipped with an internal load, comprises steps consisting in:

drilling in a central plate 20 a rectilinear beam tunnel 21 of same direction as the longitudinal axis z of a central plate 20, and a serpentine-shaped folded slit 22 having its folds in the direction of the width of the waveguide;

producing at least one groove 25 of cross section that may be variable, along the longitudinal axis z of the waveguide, in at least one face internal to the waveguide of a lower plate 23, of an upper plate 24 or of the central plate 20, and at least partially comprising a lossy material;

placing the lower plate 23 and the upper plate 24 closing the waveguide, under and on the central plate 20, respectively;

so as to form a closed slow-wave structure through which propagates a hybrid slow wave the amplitude of which is attenuated by at least 20 dB between the start and end of the portion of the one or more grooves containing a lossy material.

The plates, which are generally parallelepipedal, may be produced using conventional laminating or milling processes.

The beam tunnel 21 may be produced by electrical discharge machining (EDM), and the slit 22 in the central plate may be produced by wire EDM.

The grooves 25 may be produced by micro-milling or by EDM.

The invention claimed is:

1. A folded-waveguide slow-wave structure equipped with an internal load, comprising:

a central plate comprising a rectilinear beam tunnel of same direction as the longitudinal axis of the central plate, and a serpentine-shaped folded slit having a plurality of folds in the direction of the width of the waveguide;

a lower plate and an upper plate closing the waveguide, said plates being placed under and on the central plate, respectively;

at least one groove of cross section that may be variable, produced along the longitudinal axis of the waveguide, in at least one face internal to the waveguide of the lower plate, the upper plate or the central plate, and at least partially comprising a lossy material;

in order to form a closed slow-wave structure through which propagates a hybrid slow wave the amplitude of which is attenuated by at least 20 dB between the start and the end of the portion of the at least one groove of cross section containing a lossy material.

2. The folded-waveguide slow-wave structure according to claim 1, wherein the lossy material is a lossy dielectric.

3. The folded-waveguide slow-wave structure according to claim 2, wherein at least one groove has a constant cross section and comprises an amount of a given lossy dielectric that increases as the abscissa increases along the axis of the waveguide oriented in the direction of wave propagation.

4. The folded-waveguide slow-wave structure according to claim 2, wherein at least one groove has a cross section that remains constant or that increases as said abscissa increases and is filled with lossy dielectric the level of microwave losses of which increases as said abscissa increases.

5. The folded-waveguide slow-wave structure according to claim 1, wherein the lossy material is a layer of a mixture of metals chosen from iron, nickel, molybdenum and titanium, at least partially covering the internal surface of a groove.

6. The folded-waveguide slow-wave structure according to claim 5, wherein at least one groove has a cross section the edge length of which remains constant and comprises an amount of a layer of said same mixture of metals that increases as said abscissa increases.

7. The folded-waveguide slow-wave structure according to claim 5, wherein at least one groove has a cross section the edge length of which remains constant or increases as said abscissa increases and comprises a layer of said same mixture of metals.

8. A process for manufacturing a folded-waveguide slow-wave structure equipped with an internal load, comprising:

drilling in a central plate a rectilinear beam tunnel of same direction as the longitudinal axis of a central plate, and a serpentine-shaped folded slit having a plurality of folds in the direction of the width of the waveguide;

producing at least one groove of cross section that may be variable, along the longitudinal axis of the waveguide, in at least one face internal to the waveguide of a lower plate, of an upper plate or of the central plate, and at least partially comprising a lossy material; and placing the lower plate and the upper plate closing the waveguide, under and on the central plate, respectively;

so as to form a closed slow-wave structure through which propagates a hybrid slow wave the amplitude of which is attenuated by at least 20 dB between the start and the end of the portion of the at least one groove of cross section containing a lossy material.

* * * * *